US011631946B2

(12) United States Patent
Ji et al.

(10) Patent No.: US 11,631,946 B2
(45) Date of Patent: Apr. 18, 2023

(54) PLUG-IN STRUCTURE AND A LAMP USING THE PLUG-IN STRUCTURE

(71) Applicants: Self Electronics Co., Ltd., Zhejiang (CN); Wanjiong Lin, Zhejiang (CN); Self Electronics USA Corporation, Norcross, GA (US)

(72) Inventors: Feng Ji, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 75 days.

(21) Appl. No.: 17/302,821

(22) Filed: May 13, 2021

(65) Prior Publication Data

US 2021/0376512 A1 Dec. 2, 2021

(30) Foreign Application Priority Data

May 28, 2020 (CN) ..... 202010469964.6

(51) Int. Cl.

| | |
|---|---|
| ***H01R 4/48*** | (2006.01) |
| ***H01R 13/11*** | (2006.01) |
| ***F21V 23/06*** | (2006.01) |
| ***H01R 12/75*** | (2011.01) |
| ***H01R 13/516*** | (2006.01) |
| ***H01R 33/06*** | (2006.01) |

(52) U.S. Cl.

CPC ..... *H01R 13/11* (2013.01); *F21V 23/06* (2013.01); *H01R 12/75* (2013.01); *H01R 13/516* (2013.01); *H01R 33/06* (2013.01)

(58) Field of Classification Search

CPC ..... H01R 13/11; H01R 12/75; H01R 13/516; H01R 33/06; H01R 2103/00; H01R 13/111; F21V 23/06; F21V 23/004; F21Y 2115/10

See application file for complete search history.

(56) References Cited

U.S. PATENT DOCUMENTS 4,043,631 A * 8/1977 Lapes ..... H01R 13/28 439/865
6,955,565 B2 * 10/2005 Lloyd ..... H01R 13/6471 439/607.01
7,163,316 B2 * 1/2007 Wu ..... H05B 47/235 40/550
7,601,036 B2 * 10/2009 Cheng ..... H01R 12/716 439/857

(Continued)

*Primary Examiner* — Abdullah A Riyami
*Assistant Examiner* — Nelson R. Burgos-Guntin
(74) *Attorney, Agent, or Firm* — Wang Law Firm, Inc.

(57) ABSTRACT

A plug-in structure has at least one set of male plugs and female plugs that are mated, wherein the male plug has a pin, and the female plug includes: a mounting base, which is provided with a mounting channel for inserting the pin; multiple sets of reeds, arranged in the mounting channel at intervals along the length direction of the mounting channel for clamping the pin. A lamp can be made with the plug-in structure. According to the plug-in structure and the lamp with the plug-in structure, the multi-stage reeds are arranged in the mounting channels to clamp the pins, so that the pins can be kept straight and flat and are not prone to deforming, the insertion and extraction force can be increased, and the assembly failure rate can be reduced.

11 Claims, 8 Drawing Sheets

(56) References Cited

U.S. PATENT DOCUMENTS 7,753,701 B2 * 7/2010 Tsuji ..... H01R 13/4538 439/352
8,109,799 B2 * 2/2012 Schlipf ..... H01R 13/432 439/736
8,444,426 B1 * 5/2013 Yang ..... H01R 33/0881 439/227
8,573,993 B2 * 11/2013 Beak ..... H01R 13/7033 200/51.09
8,668,507 B2 * 3/2014 Yang ..... H01R 33/02 439/699.2
9,206,951 B2 * 12/2015 McLennan ..... F21V 21/0885
9,634,414 B1 * 4/2017 Chen ..... H01R 33/09
9,673,544 B1 * 6/2017 Chen ..... H01R 12/718
9,897,264 B1 * 2/2018 Chen ..... H01R 33/22
10,172,242 B1 * 1/2019 Chen ..... H01R 13/627
10,240,727 B2 * 3/2019 Athalye ..... F21S 8/026
10,535,951 B2 * 1/2020 Listing ..... H01R 13/631
2005/0186825 A1 * 8/2005 Yen ..... H01R 33/7614 439/336
2006/0264119 A1 * 11/2006 Milligan ..... H01R 13/42 439/752
2006/0264124 A1 * 11/2006 Meyer ..... H01R 4/185 439/877
2007/0161300 A1 * 7/2007 Ishigami ..... H01R 13/11 439/851
2008/0106900 A1 * 5/2008 Chang ..... F21V 19/0085 439/366
2008/0188143 A1 * 8/2008 Hung ..... H01R 43/16 439/842
2010/0173540 A1 * 7/2010 Lee ..... H01R 13/112 439/861
2010/0195312 A1 * 8/2010 Ko ..... G02F 1/133611 439/232
2011/0242795 A1 * 10/2011 Choi ..... H01R 13/052 439/366
2011/0318973 A1 * 12/2011 Ju ..... H01R 13/11 439/733.1
2012/0044706 A1 * 2/2012 Tsai ..... F21V 19/008 362/382
2012/0302097 A1 * 11/2012 Yang ..... H01R 33/02 439/620.02
2013/0178084 A1 * 7/2013 Yang ..... H01R 33/0836 439/236
2016/0273751 A1 * 9/2016 Xiao ..... F21V 23/006
2017/0012379 A1 * 1/2017 Chen ..... F21K 9/27
2017/0023225 A1 * 1/2017 Chen ..... H01R 13/2464
2017/0191649 A1 * 7/2017 Zhang ..... F21V 23/06
2017/0276338 A1 * 9/2017 Chen ..... H01R 12/718
2018/0006383 A1 * 1/2018 Bishop ..... H01R 13/62
2020/0381855 A1 * 12/2020 Chen ..... H01R 13/432
2020/0403360 A1 * 12/2020 Shao ..... F21V 23/06
2021/0110169 A1 * 4/2021 Rupp ..... H05K 5/0204
2021/0376512 A1 * 12/2021 Ji ..... H01R 13/111
2021/0396364 A1 * 12/2021 Ji ..... F21V 23/06
2022/0034487 A1 * 2/2022 Xue ..... H01R 12/721

* cited by examiner

PLUG-IN STRUCTURE AND A LAMP USING THE PLUG-IN STRUCTURE

RELATED APPLICATION

This application claims priority to a Chinese Patent Application No. CN 202010469964.6, filed on May 28, 2020.

FIELD OF THE TECHNOLOGY

The invention relates to the technical field of lighting equipment, in particular to a plug-in structure and a lamp using the plug-in structure.

BACKGROUND OF THE INVENTION

As lighting equipment, lamps are widely used in our lives. Common types of electric lamps include incandescent lamps, fluorescent lamps, and LED lamps and so on. Regardless of the type of electric lamp, the light source needs to be energized. The electric lamp and the external power supply are generally connected through a plug connector, but the connection between the plug connector and the light source is more variable. Welding is a common connection method, such as LED lamps. The connection between the driving circuit board and the lamp cap is mostly realized by welding, but welding is not easy to automate manufacturing. For this reason, some connectors are also used to connect to facilitate automation.

Generally, male plugs use pins, and female plugs use reeds to fix the pins in insertion structure. In the prior art, the reeds and the pins are in contact at only two points, which are prone to failure during use and provide small insertion and extraction forces. After multiple insertions and removals, the insertion force will be smaller and the failure rate will increase.

BRIEF SUMMARY OF THE INVENTION

In view of this, the present invention provides a plug-in structure and a lamp using the plug-in structure to solve the above technical problems.

A plug-in structure, comprising at least one set of male plug and female plug that are mated, wherein the male plug comprises a pin, the female plug includes:

a mounting base, which is provided with a mounting channel for inserting the pin;

multiple sets of reeds arranged in the mounting channel at intervals along the length direction of the mounting channel for clamping the pin.

the multiple sets of reeds comprise a first set of reeds arranged near the inlet end of the mounting channel and a second set of reeds arranged behind the first set of reeds, the clamping force of the first set of reeds is greater than that of the second set of reeds.

the first set of reeds includes at least two first reeds, which are circumferentially distributed arranged around the pin.

the first reed comprises a first root portion, a first sheet body and a first top end, the first root portion is fixed to the side wall of the mounting channel, and the first sheet body is inclined inwardly from the opening and arranged in the mounting channel, and the first top end is close to or located at the center line of the mounting channel and is abuts against the pin.

the first top end has a cut surface inclined in an outward direction from the opening.

the second set of reeds includes at least two second reeds, which are circumferentially distributed around the pin.

the second reed comprises a second root portion, a second sheet body and a second top end, the second root portion is fixed to side wall of the mounting channel, and the second sheet body includes a second front section arranged inclined inwardly from the opening inward in the installation channel, and a second middle section arranged in parallel from the opening inward and connected to the second front section, the second top end turns over to the side wall direction of the mounting channel, and the second middle section abuts against the pin.

the second set of reeds further comprises a third reed, which has a same number as the second reed and are cross distributed with the second reed in the circumferential direction of the pin.

the third reed comprises a third root portion, a third sheet body and a third top end, the third root portion and the third top end are respectively fixed to the side wall of the mounting channel, and the middle portion of the third sheet body is recessed in the direction of the center line of the mounting channel and pressed against the pin.

the female plug is wound from metal sheets.

A lamp, comprising a lamp holder, a driving circuit board arranged on the lamp holder, and a lamp cap arranged on the lamp holder, the lamp cap and the driving circuit board are electrically connected through the plug-in structure.

the plug-in structure is provided with two sets of male plugs and female plugs, the lamp cap is provided with a male plug, and the female plug is arranged on the driving circuit board.

a fixing box is provided on the driving circuit board, and the fixing box is provided with two mounting cavities for accommodating the mounting base.

the female plug is arranged at one end of front surface of the driving circuit board.

In the above, the inward and outward direction from the opening represent the direction, not the position. The inward direction from the opening refers to the direction the plug is inserted in and the outward direction from the opening refers to the direction the plug is pulled out.

The second reed and the third reed in the second set of reeds can be replaced by the first reed, and the first reed in the first set of reeds can be replaced by the second reed and/or the third reed, and the replacement does not exceed the protection scope of the present invention.

Technical effects of the present invention:

In the plug-in structure of the present invention and the lamp adopting the plug-in structure, multi-level reeds are arranged in the installation channel to clamp the pins, which is not only beneficial to keep the pins straight and not easily deformed, but also can increase the plug force increased and reduce assembly failure rate.

BRIEF DESCRIPTION OF THE DRAWINGS

The embodiments of the present invention are described below in conjunction with the drawings, in which.

DETAILED DESCRIPTION OF THE INVENTION

Figure 1:
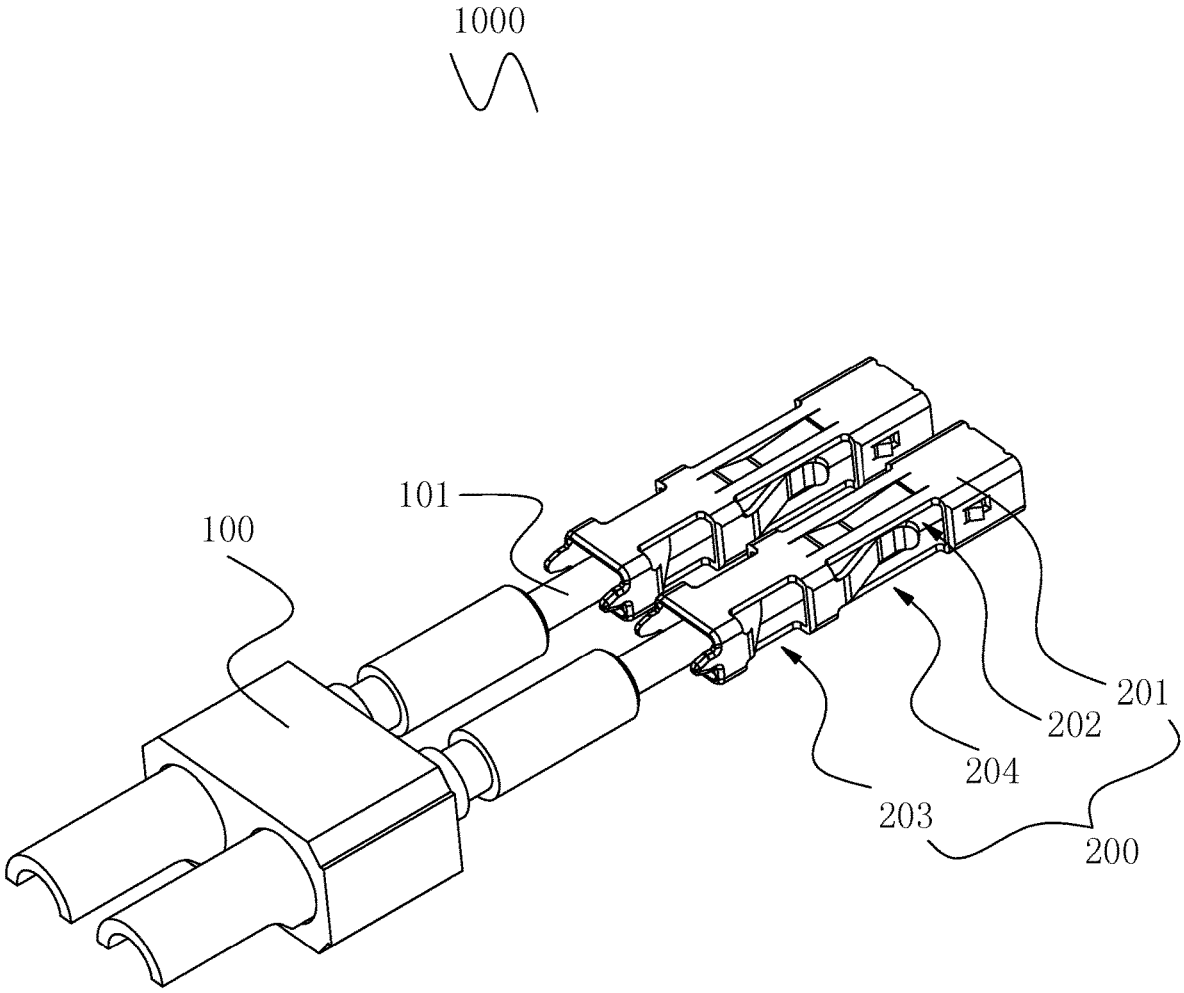
FIG. 1 is a schematic diagram of the assembly structure of the plug-in structure of this embodiment.
Figure 2:
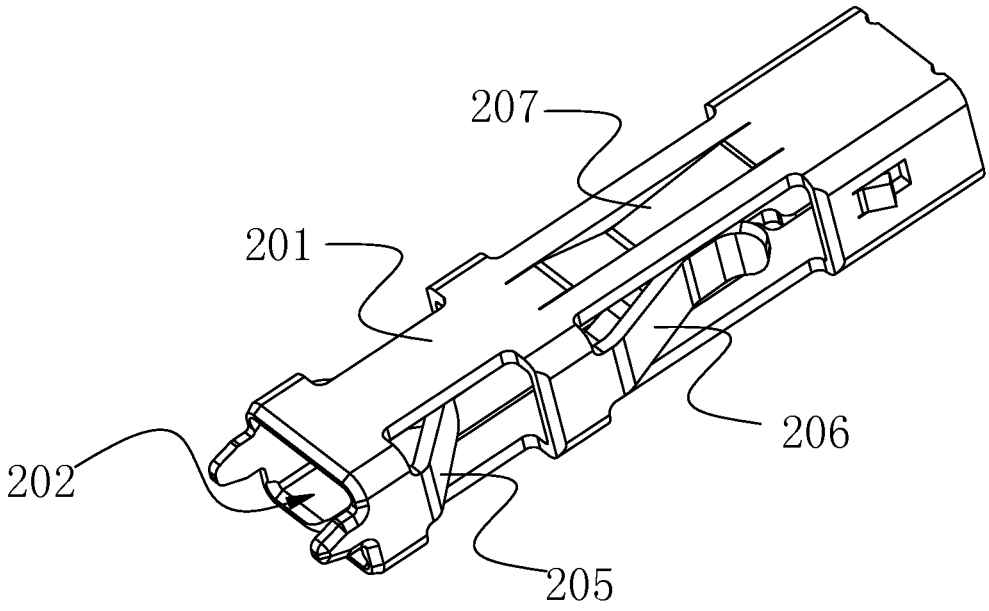
FIG. 2 is a schematic diagram of the three-dimensional structure of the female plug of this embodiment.
Figure 3:
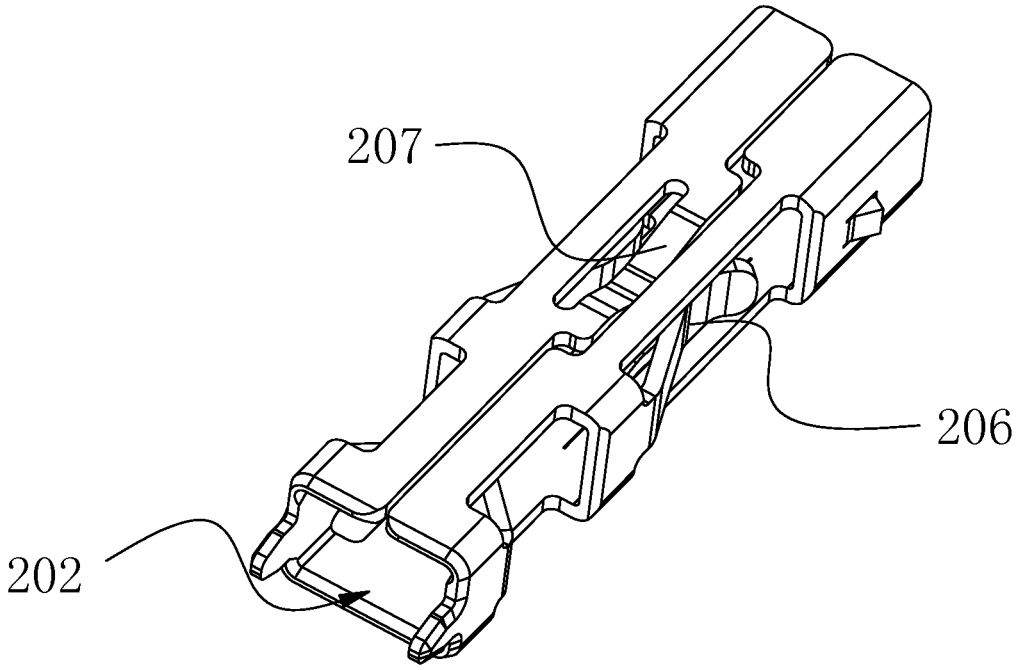
FIG. 3 is a schematic diagram of the three-dimensional structure of the female plug of this embodiment from another perspective.
Figure 4:
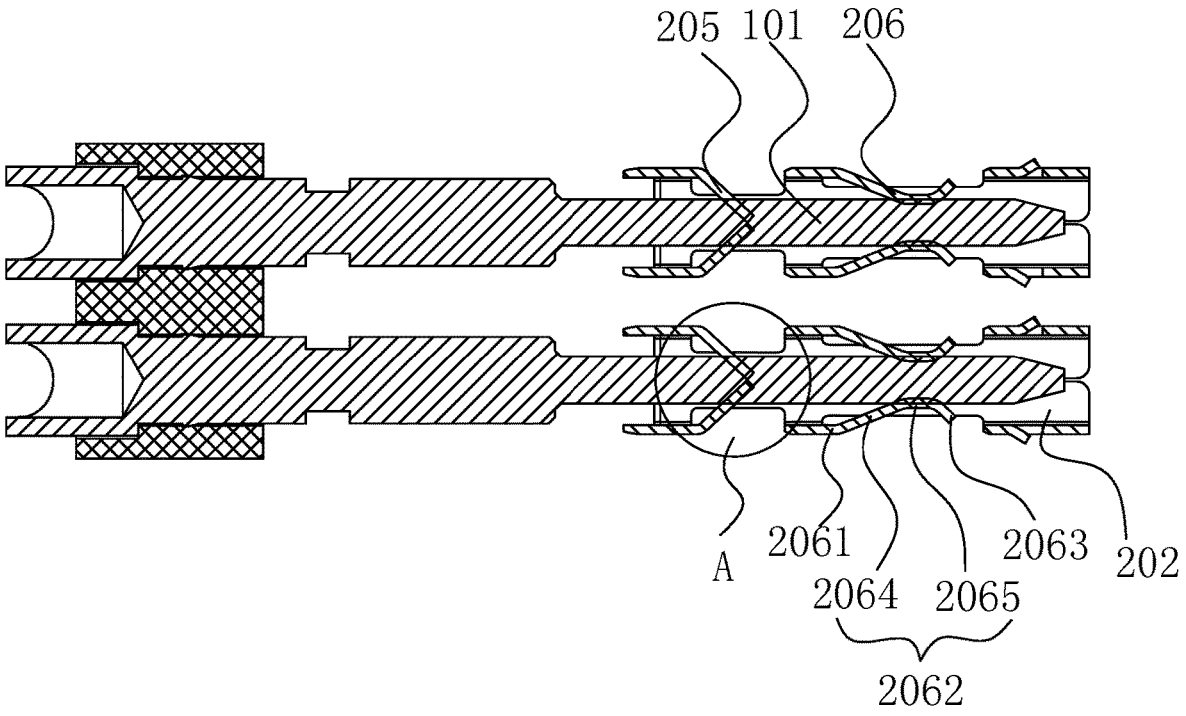
FIG. 4 is a schematic sectional view of the plug-in structure of this embodiment.
Figure 5:
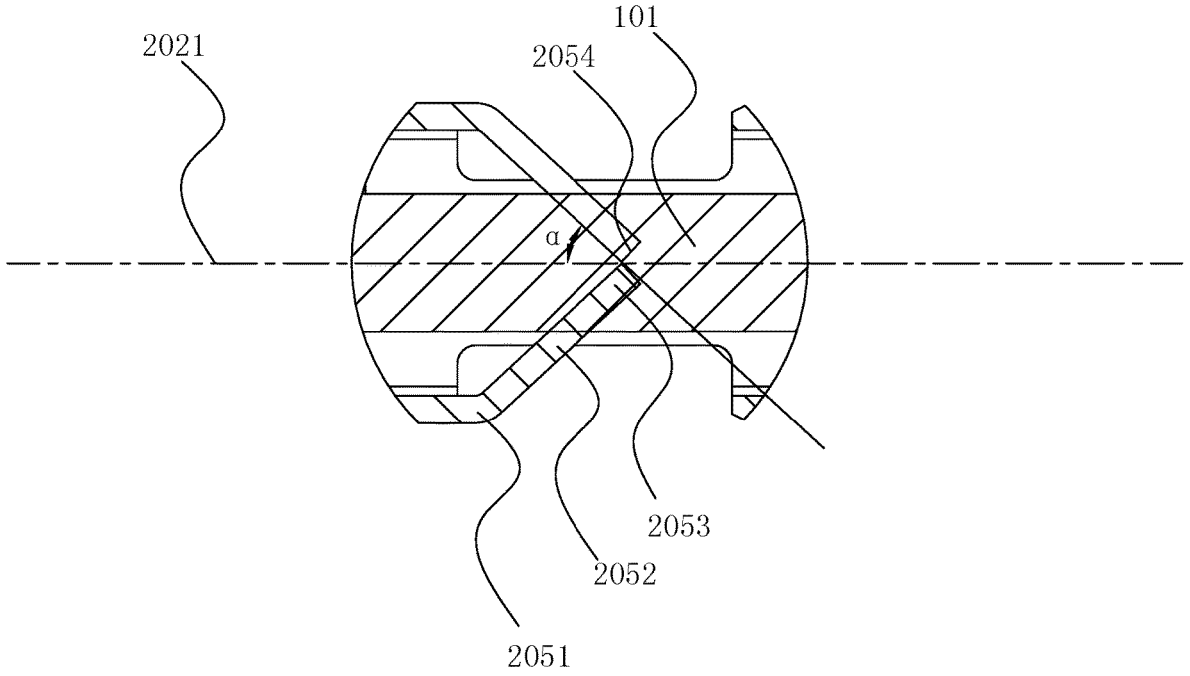
FIG. 5 is an enlarged diagram of part A of FIG. 4.
Figure 6:
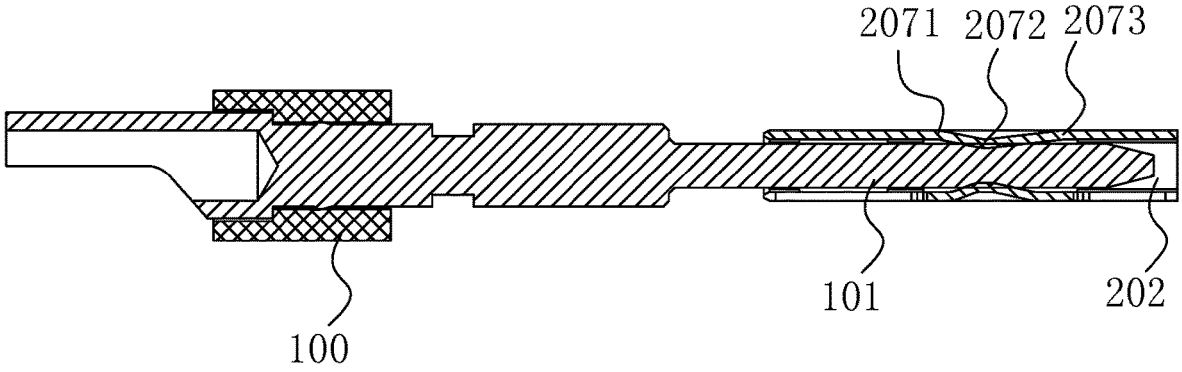
FIG. 6 is a cross-sectional view (which is perpendicular to the sectional view of FIG. 4) of the plug-in structure of this embodiment.

Specific embodiments of the present invention will be described in further detail below based on the drawings. It should be understood that the description of the embodiments of the present invention herein is not intended to limit the protection scope of the present invention.

As shown in FIG. 1-6, the plug-in structure 1000 of this embodiment includes a male plug 100 and a female plug 200 that are mated. The male plug 100 includes a pin 101, and the female plug 200 includes a mounting base 201, a first set of reeds 203 and a second set of reeds 204. The mounting base 201 is provided with a mounting channel 202 for inserting the pin 101; the first set of reeds 203 and the second set of reeds 204 are arranged in the mounting channel 202 at intervals for clamping the pin 101.

The number of sets of reeds can be set according to the requirements of the clamping force. In this embodiment, there are two sets in consideration of the balance between the volume and the requirements of the clamping force.

In this embodiment, the clamping force of the first set of reeds 203 is greater than that of the second set of reeds 204. The overall clamping effect is better and the pins are not easily deformed.

In order to reduce the size and simplify the structure, while maintaining the balance of the clamping force of each set of reeds, in this embodiment, the first set of reeds 203 includes two first reeds 205, which are circumferentially distributed around the pin 101 and symmetrically arranged. The first reed 205 includes a first root portion 2051, a first sheet body 2052, and a first top end 2053. The first root portion 2051 is fixed to the side wall of the mounting channel 202, and the first sheet body 2052 is inclined inward from the opening and arranged in the mounting channel 202, and the first top end 2053 is close to or located at the center line 2021 of the mounting channel 202 and abuts against the pin 101.

When the pin 101 is inserted into the mounting channel 202, the first top end 2053 is pulled apart and pressed against the pin 101 to achieve clamping. The clamping force is related to the degree to which the tilt angle of the first sheet 2052 and the degree to which the first top end 2053 is close to the centerline of the mounting channel 202. The tilt angle a of the first sheet body 2052 can be set between 35° and 55°. In this embodiment, a=43°. When the pin 101 exits the installation channel 202, the first reed 205 generates a relatively large insertion and extraction force due to friction.

In order to further increase the insertion and extraction force and prevent the pin 101 from coming out, in this embodiment, the first top end 2053 has a cut surface 2054 inclined outward from the opening, which can increase resistance when the pin 101 is pulled out.

In order to reduce the size and simplify the structure and maintain the balance of the clamping force of each set of reeds, in this embodiment, the second set of reeds 204 includes two second reeds 206, which are circumferentially distributed around the pin 101 and symmetrically arranged.

The second reed 206 includes a second root portion 2061, a second sheet body 2062, and a second top end 2063. The second root portion 2061 is fixed to the side wall of the mounting channel 202. The second sheet body 2062 includes a second front section 2064 arranged inclined inwardly from the opening inward in the installation channel 202, and a second middle section 2065 arranged in parallel from the opening inward and connected to the second front section 2064. The second top end 2063 turns over to the side wall direction of the installation channel 202, and the second middle section 2065 abuts against the pin 101. The second middle section 2065 extends in the length direction of the mounting channel 202 so as to form a surface contact with the pin 101, which can increase the current load of the electrical connection and improve the stability and safety.

In order to improve the clamping force of the second set of reeds 204, in this embodiment, the second set of reeds 204 further includes two third reeds 207, which are cross distributed with the second reed 206 in the circumferential direction of the pin 101. Specifically, the third reed 207 includes a third root portion 2071, a third sheet body 2072, and a third top end 2073. The third root portion 2071 and the third top end 2073 are respectively in the front and rear fixed to the side wall of the mounting channel 202. The middle portion of the third sheet body 2072 is recessed in the direction of the center line of the mounting channel 202 and pressed against the pin 101. The reeds of the above structure have a relatively large clamping force and are used in conjunction with the second set of reeds 204 to increase the current load while ensuring the clamping force there. The recess of the third sheet body 2072 is in line contact with the pin 101.

In this embodiment, the cross section of the mounting channel 202 is rectangular, the two first reeds 205 are arranged on opposite sides, and the two second set of reeds 204 and the two third reeds 207 are respectively arranged on the four sides.

The mounting base 201 of the female plug 200 and each elastic piece can be manufactured separately and then fixedly connected, but this is not only time-consuming and labor-intensive, but also difficult to make the size small. In this embodiment, the female plug 200 is wound from metal sheets. Each elastic piece can be formed by blanking, punching, stamping and other processes on the metal sheet.

The plug-in structure 1000 of this embodiment has a large plug-in force and current load while being small in size.

The second reed 206 and the third reed 207 in the second set of reeds 204 can be replaced by the first reed 205, and the first reed 205 in the first set of reeds 203 can be replaced by the second reed 206 and/or the third reed 207, and the replacement does not exceed the protection scope of the present invention.

Figure 7:
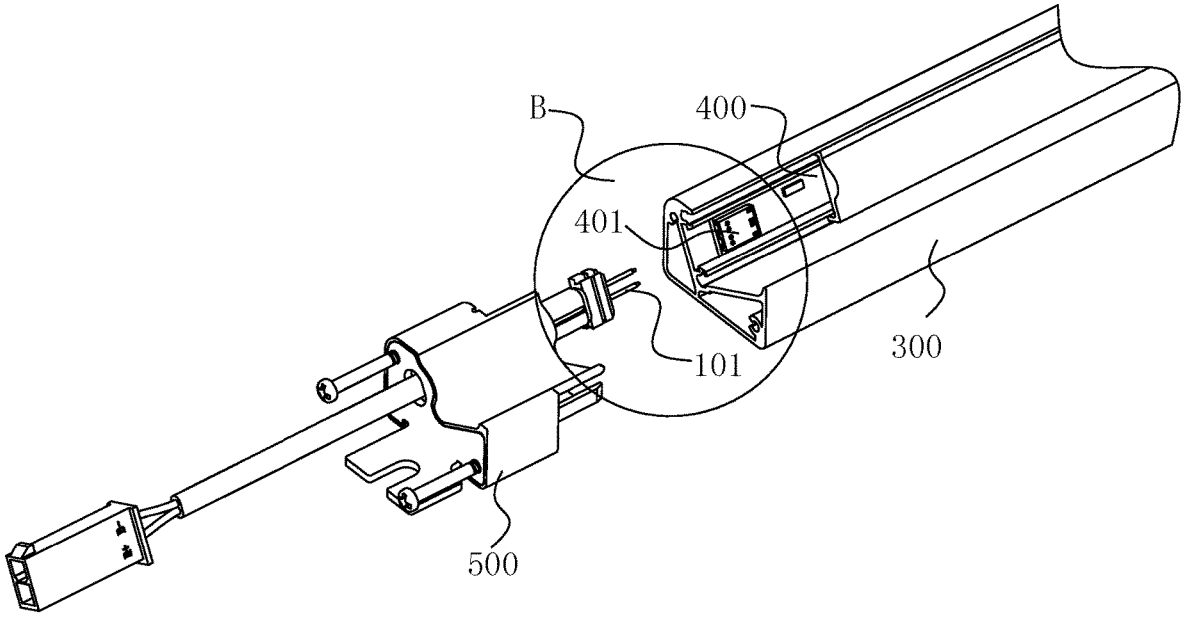
FIG. 7 is a partial structural diagram of the lamp of this embodiment.
Figure 8:
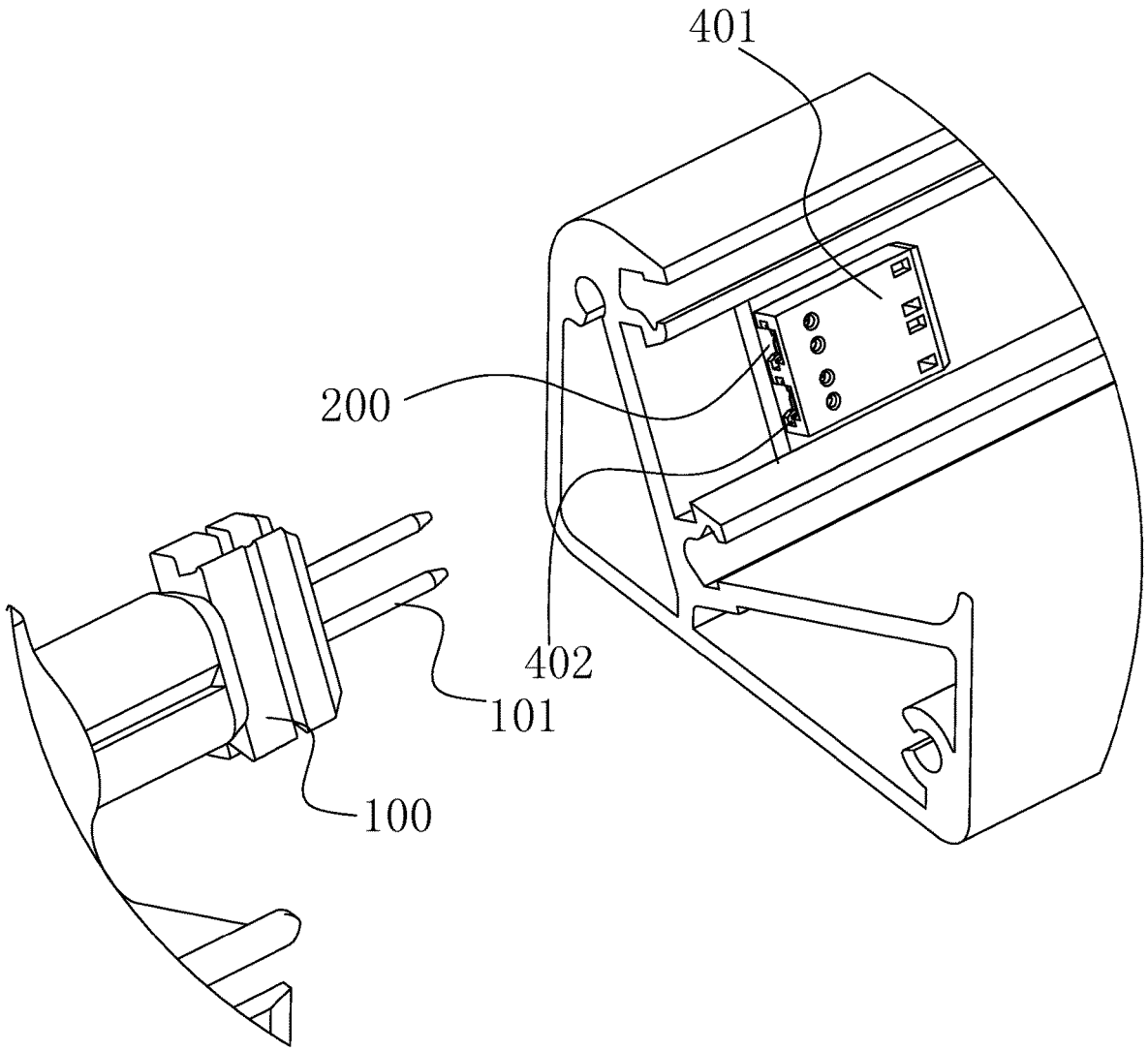
FIG. 8 is an enlarged schematic diagram of part B of FIG. 7.

As shown in FIG. 7 and 8, the lamp of this embodiment includes a lamp holder 300, a driving circuit board 400 disposed on the lamp holder 300, and a lamp cap 500 disposed on the lamp holder 300. The lamp cap 500 and the driving circuit board 400 realizes electrical connection through the above plug-in structure 1000. The plug-in structure 1000 is provided with two sets of male plugs 100 and female plugs 200, two male plugs 100 is provided in the lamp cap 500, and two female plugs 200 are arranged on the driving circuit board 400. The driving circuit board 400 is provided with a fixing box 401, and the fixing box 401 is provided with two mounting cavities 402 for accommodating the mounting base 201. The female plug 200 is provided at the end of the front surface of the driving circuit board 400.

The above are only preferred embodiments of the present invention, and are not used to limit the protection scope of the present invention. Any modification, equivalent replacement or improvement within the spirit of the present invention is covered by the scope of the claims of the present invention.

What is claimed is:

1. A plug-in structure (1000), comprising at least one set of male plug (100) and female plug (200) that are mated, wherein the male plug (100) comprises a pin (101), characterized in that, the female plug (200) includes:

a mounting base (201), which is provided with a mounting channel (202) for inserting the pin (101);

multiple sets of reeds (203, 204), arranged in the mounting channel (202) at intervals along the length direction of the mounting channel (202) for clamping the pin (101);

wherein the multiple sets of reeds (203, 204) comprise a first set of reeds (203) arranged near the inlet end of the mounting channel (202) and a second set of reeds (204) arranged behind the first set of reeds (203), the clamping force of the first set of reeds (203) is greater than that of the second set of reeds (204);

the first set of reeds (203) includes at least two first reeds (205), which are circumferentially distributed arranged around the pin (101), the first reeds (205) comprise a first root portion (2051), a first sheet body (2052) and a first top end (2053), the first root portion (2051) is fixed to the side wall of the mounting channel (202), and the first sheet body (2052) is inclined inwardly from the opening and arranged in the mounting channel (202), and the first top end (2053) is close to or located at the center line of the mounting channel (202) and abuts against the pin (101).

2. The plug-in structure (1000) as claimed in claim 1, wherein the first top end (2053) has a cut surface inclined in an outward direction from the opening.

3. The plug-in structure (1000) as claimed in claim 1, wherein the second set of reeds (204) includes at least two second reeds (206), which are circumferentially distributed around the pin (101).

4. The plug-in structure (1000) as claimed in claim 3, wherein the second reed (206) comprises a second root portion (2061), a second sheet body (2062) and a second top end (2063), the second root portion (2061) is fixed to side wall of the mounting channel (202), and the second sheet body (2062) includes a second front section (2064) arranged inclined inwardly from the opening inward in the installation channel (202), and a second middle section (2065) arranged in parallel from the opening inward and connected to the second front section (2064), the second top end (2063) turns over to the side wall direction of the mounting channel (202), and the second middle section (2065) abuts against the pin (101).

5. The plug-in structure (1000) as claimed in claim 3, wherein the second set of reeds (204) further comprises a third reed (207), which has a same number as the second reed (206) and are cross distributed with the second reed (206) in the circumferential direction of the pin (101).

6. The plug-in structure (1000) as claimed in claim 5, wherein the third reed (207) comprises a third root portion (2071), a third sheet body (2072) and a third top end (2073), the third root portion (2071) and the third top end (2073) are respectively fixed to the side wall of the mounting channel (202), and the middle portion of the third sheet body (2072) is recessed in the direction of the center line of the mounting channel (202) and pressed against the pin (101).

7. The plug-in structure (1000) as claimed in claim 1, wherein the female plug (200) is wound from metal sheets.

8. A lamp, comprising a lamp holder (300), a driving circuit board (400) arranged on the lamp holder (300), and a lamp cap (500) arranged on the lamp holder (300), characterized in that: the lamp cap (500) and the driving circuit board (400) are electrically connected through the plug-in structure (1000) as claimed in claim 1.

9. The lamp as claimed in claim 8, wherein the plug-in structure (1000) is provided with two sets of male plugs (100) and female plugs (200), and the lamp cap (500) is provided with a male plug (100), and the female plug (200) is arranged on the driving circuit board (400).

10. The lamp as claimed in claim 9, wherein a fixing box (401) is provided on the driving circuit board (400), and the fixing box (401) is provided with two mounting cavities (402) for accommodating the mounting base (201).

11. The lamp as claimed in claim 9, wherein the female plug (200) is arranged at one end of front surface of the driving circuit board (400).

* * * * *